United States Patent [19]

Ueda et al.

[11] 4,445,020

[45] Apr. 24, 1984

[54] CIRCUIT INTERRUPTER

[75] Inventors: Yoshihiro Ueda; Hiroyuki Sasao; Suenobu Hamano; Suichiro Okuda, all of Amagasaki, Japan

[73] Assignee: Mitsubishi Denki Kabushiki Kaisha, Tokyo, Japan

[21] Appl. No.: 479,920

[22] Filed: Apr. 4, 1983

Related U.S. Application Data

[63] Continuation-in-part of Ser. No. 152,179, May 22, 1980, abandoned.

[30] Foreign Application Priority Data

| | | | |
|---|---|---|---|
| May 25, 1979 | [JP] | Japan | 54-66005 |
| May 25, 1979 | [JP] | Japan | 54-66007 |
| May 28, 1979 | [JP] | Japan | 54-66364 |
| May 28, 1979 | [JP] | Japan | 54-66365 |
| May 29, 1979 | [JP] | Japan | 54-68634 |
| May 29, 1979 | [JP] | Japan | 54-68637 |
| Jun. 25, 1979 | [JP] | Japan | 54-80903 |
| Jun. 25, 1979 | [JP] | Japan | 54-80904 |
| Jun. 25, 1979 | [JP] | Japan | 54-80905 |
| Jun. 25, 1979 | [JP] | Japan | 54-80906 |
| Jun. 25, 1979 | [JP] | Japan | 54-80907 |
| Jul. 23, 1979 | [JP] | Japan | 54-93920 |

[51] Int. Cl.[3] ..... H01H 33/88

[52] U.S. Cl. ..... 200/148 A; 200/148 R

[58] Field of Search ..... 200/148 A, 148 R

[56] References Cited

U.S. PATENT DOCUMENTS

| | | | |
|---|---|---|---|
| 2,246,171 | 6/1941 | Grosse | 200/148 A |
| 3,987,261 | 10/1976 | McConnell | 200/148 A |
| 4,160,888 | 7/1979 | Natsui et al. | 200/148 A |

FOREIGN PATENT DOCUMENTS

| | | | |
|---|---|---|---|
| 1540177 | 1/1970 | Fed. Rep. of Germany | 200/148 A |
| 207245 | 9/1966 | Switzerland | 200/148 A |
| 450251 | 4/1975 | U.S.S.R. | 200/148 A |

*Primary Examiner*—Robert S. Macon

*Attorney, Agent, or Firm*—Oblon, Fisher, Spivak, McClelland & Maier

[57] ABSTRACT

A circuit interrupter comprises a pair of mutually detachable contacts;

a cylinder-piston negative pressure device for providing a negative pressure by detaching said contacts; and a suction guide for feeding the arcing formed by the detaching operation of said contacts, into said cylinder-piston negative pressure device.

4 Claims, 53 Drawing Figures

CIRCUIT INTERRUPTER

This application is a continuation-in-part, of application Ser. No. 152,179, filed May 22, 1980 now abandoned.

BACKGROUND OF THE INVENTION

1. Field of the Invention

The present invention relates to a circuit interrupter used in a large power circuit. More particularly, it relates to a circuit interrupter in which an arc-extinction is performed by sucking the arc by a negative pressure caused by a detaching operation of a contact.

2. Description of the Prior Arts

In a conventional circuit interrupter for arc-extinction by utilizing $SF_6$ gas etc., the gas pressurized by a compressing device is puffed to the arc formed at the current cut-off or the gas pressurized by a cylinder-piston interlocked to a movable contact is puffed to the arc at the current cut-off.

The former has a disadvantage of the requirement of the compressing device which makes a complicated structure and the latter which pressurizes the gas by the cylinder-piston has a disadvantage that a clogging phenomenon is caused at the cut-off of a large current to highly increase the pressure in the cylinder so as to require a large driving force for shifting the movable contact.

Beside the both types of the circuit interrupters, it has been considered to use a circuit interrupter which performs the arc-extinction by the arcing at the current cut-off without using neither the high pressure compressing device nor the system for pressurizing the gas by the driving force.

In accordance with this system, arc energy is too small at the cut-off with a small current, whereby pressurizing in a storage chamber for a gas expanding by the arc is not expected and arc extinction ability is lowered.

SUMMARY OF THE INVENTION

An embodiment of this invention is to provide a circuit interrupter which comprise a cylinder piston type negative pressure device which form a negative pressure by interlocking to mutually detachable contacts to suck the arc by the negative pressure function of the negative pressure device and to suck a cold gas around the arc so as to mix with the arc whereby the arc-extinction is performed under cooling it.

In accordance with the present invention, the negative pressure function is utilized instead of the suffer breaker having high cylindrical pressure difference under the consideration of the clogging phenomenon caused by the arcing whereby a pressure difference is not over the initial pressure as the principle so as to reduce the driving force for the contact. Moreover, when a nozzle for sucking the arc is used and an effective sectional area in the guide for sucking the arc is varied by shifting the contact, the structure of the circuit interrupter is simple. In accordance with this structure, the arc is the free arc during the small effective sectional area of the guide for sucking to cause the negative pressure. Therefore, the arc voltage can be lower than that of the other breaker and the energy for the current interrupter can be small so as to minimize the current interrupter.

Another embodiment of the present invention is to provide a circuit interrupter which comprises a cylinder-piston type negative pressure device in which a gas storage chamber is formed by a stationary cylinder and a pair of contacts being detachable in the stationary cylinder to cause the negative pressure depending upon the detaching operation of the contacts whereby the gas is rapidly discharged from the storage chamber to precisely attain the cut-off even though the small current cut-off is performed under a low gas pressure in the storage.

The other embodiment of the present invention is to provide a current interrupter which comprises a first guide for sucking the arc by connecting a storage chamber to a suction chamber and a second guide for sucking a cold gas by connecting the storage chamber to the out of the storage chamber whereby the cold gas is sucked from out of the storage chamber by the negative pressure forcibly given, and the arc is sucked through the first guide so as to mix the cold gas with the arc to perform the arc-extinction in the case of a small current cut-off with a low gas pressure in the storage chamber by the arcing. In the embodiment, the cold extinction gas out of the storage chamber can be also sucked to mix with the arc through the opening of the arc-contact by the negative pressure chamber together with the mixing of the arc with the cold extinction gas in the storage chamber in the current cut-off whereby the small current breaking is easily attained and the capacity of the storage chamber can be reduced to minimize the size of the current interrupter.

The other embodiment of the present invention is to provide a current interrupter which has high insulating strength in the current breaking for a large capacity.

The other embodiment of the present invention is to provide a current interrupter in which the suction chamber is connected to the atmosphere during the detaching operation of the contacts to discharge the arc energy whereby the current cut-off for larger current than that of said current interrupter can be smoothly performed without any breakdown after the detaching of the contacts.

The other embodiment of the present invention is to provide a current interrupter in which the gas pressure in the storage chamber is raised by the arcing and the gas is rapidly discharged from the storage chamber into the suction chamber by reducing the pressure in the suction chamber of the negative pressure device to perform the arc-extinction and a sectional area of the suction guide connecting the storage chamber to the suction chamber of the negative pressure device is reduced during the wiping for the movement of the contact or at the beginning of the arcing, but it is enlarged during the later step for current cut-off, thereby increasing the effect for the negative pressure.

The other embodiment of the present invention is to provide a current interrupter having large breakdown capacity which comprises two or more steps of suction chambers of the negative pressure devices.

The other embodiment of the present invention is to provide a compact current interrupter having a large breakdown capacity which comprises a plurality of suction chambers for negative pressure in a coaxial form.

The other embodiment of the present invention is to provide a current interrupter equipped with a negative pressure device which comprises a main contact beside an arcing contact so as to be used for a circuit through which a large current is usually passed.

The other embodiment of the present invention is to provide a current interrupter having a large breakdown capacity in which the effect of the negative pressure device is increased by mixing the gas remained in the suction chamber at the ambient temperature is mixed with a hot gas.

The other embodiment of the present invention is to provide a circuit interrupter having excellent breakdown function in which the effect of the negative pressure device is increased by a plate for cooling and mixing in the suction guide or the suction chamber so as to improve the cooling of the hot gas fed into the suction chamber or the mixing with the cold gas in the suction chamber.

BRIEF DESCRIPTION OF THE DRAWINGS

FIG. 1 shows the closing state; FIGS. 2 to 3 shows the current breaking operation; FIG. 4 shows the state of the completion of the current breaking.

FIG. 8 shows the closing state; FIG. 9 shows the breaking operation; FIG. 10 shows the state of the completion of the current cut-off.

FIGS. 48 to 63 are sectional views of the other embodiment of the current interrupter of the present invention.

DETAILED DESCRIPTION OF THE PREFERRED EMBODIMENTS

Figure 1:
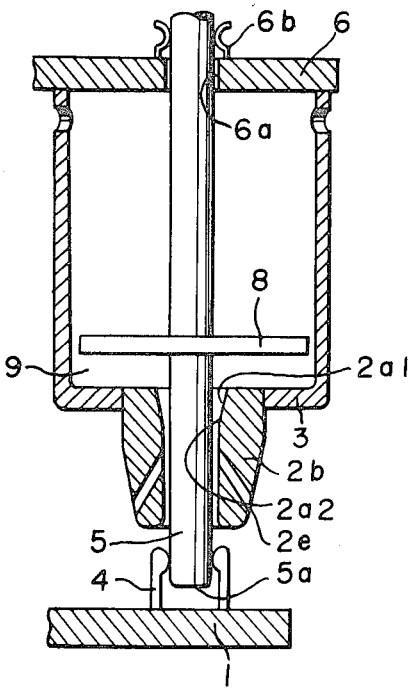
FIGS. 1 to 4 are sectional views of one embodiment of the current interrupter of the present invention.

Referring to the drawings embodiments of the present invention will be illustrated in detail.

In FIGS. 1 to 4, the reference numeral (1) designates a terminal plate held on a stationary part (not shown); (4) designates a first contact fixed to the terminal plate; (5) designates a shaft type second contact which is detachable to the first contact (4) by a driving device (not shown). The other end is slidably fitted to a through-hole **(6*a*) of the terminal plate (6) and is electrically connected through a collector (6*b*) fixed to the terminal plate (6). A cylinder (3) is fixed at the end of the terminal plate (6) so as to form the negative pressure device with the shaft type contact (5) as the piston rod. An insulating nozzle (2*b*) surrounding the shaft type contact (5) projected is fixed to the rear end of the cylinder. An opening (2*e*) for sucking the gas into the nozzle (2*b*) is formed. A gas suction guide is formed by the inner surface ($2a_2$) of the nozzle and a tapered part ($2a_1$) enlarging from the inner surface to the connection of the cylinder (3). The reference numeral (8) designates a piston which is fixed to the shaft type contact (5) and to fit to the cylinder (3) and a suction chamber (9) is formed by the piston (7) and the cylinder (5)**.

The current interrupter having said structure is held in a vessel (not shown) filled with $SF_6$ gas.

Figure 2:
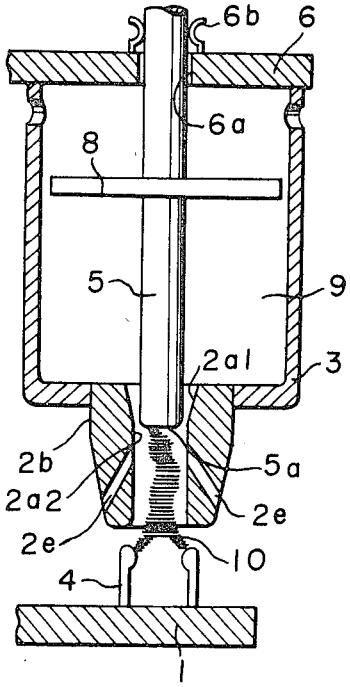

In the current interrupter having the structure in order to break the electric passage of the first and second contacts (4), (5), in the closed state, as shown in FIG. 1, the second contact (5) is upwardly shifted by the driving device (not shown) whereby the arc (10) is formed between the contact (4) and the end surface **(5*a*) of the shaft type second contact (5) as shown in FIG. 2 wherein the arc is the free arc. The effective sectional area of the suction guide is the narrow space formed by the inner surface ($2a_2$) of the insulating nozzle (2*b*) and the outer surface of the shaft type contact (5)**. Therefore, it is not affected to the arc.

Figure 3:
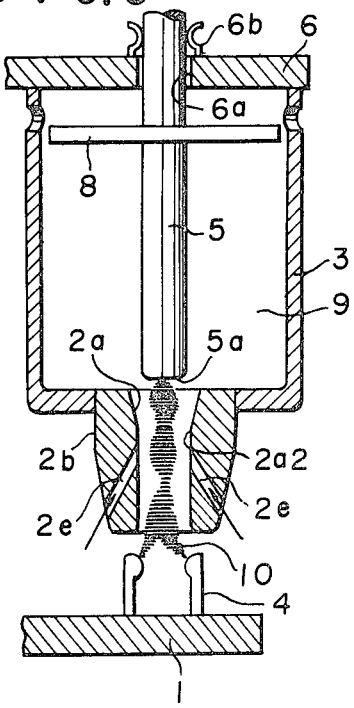
Figure 4:
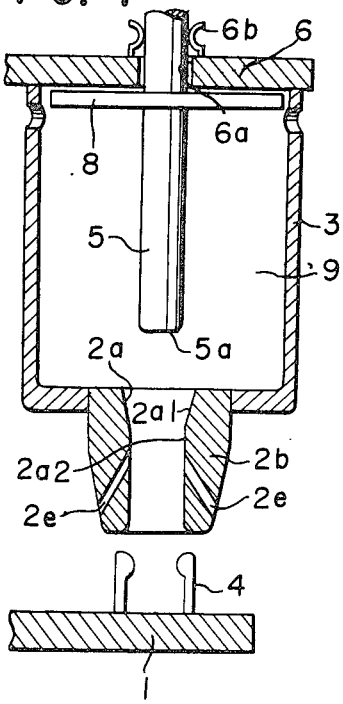

In the suction chamber (9) of the negative pressure device, the sectional area of the suction guide is small, to cause the negative pressure required for the arc-extinction. When the sectional area of the suction guide is increased as shown in FIG. 3, the arc is rapidly sucked and the cold gas is also sucked through the opening **(2*e*) of the nozzle (2*b*) to perform the arc-extinction under cooling. The arc-extinction state is shown in FIG. 4**.

Figure 5:
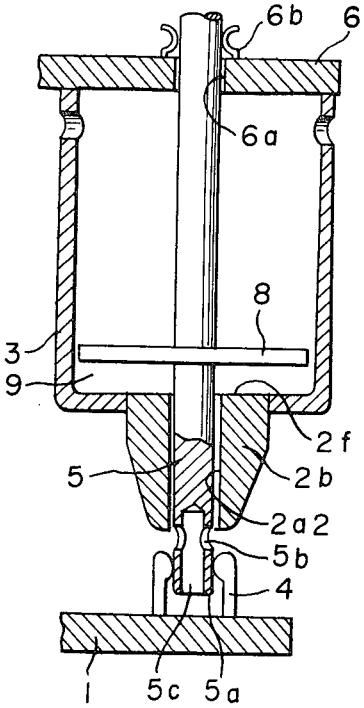
FIG. 5 is a sectional view of the other embodiment of the current interrupter of the present invention.
Figure 6:
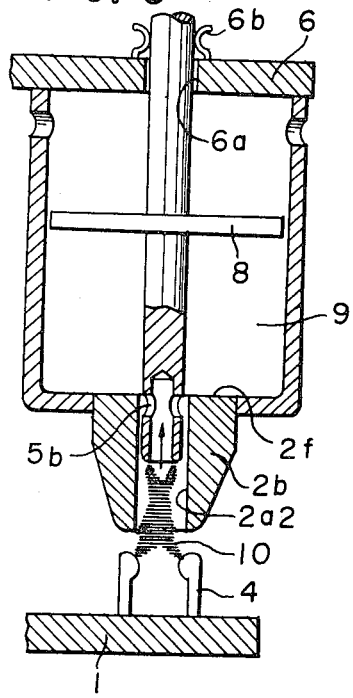
FIGS. 6 and 7 are sectional views showing the states of the current breaking operation.
Figure 7:
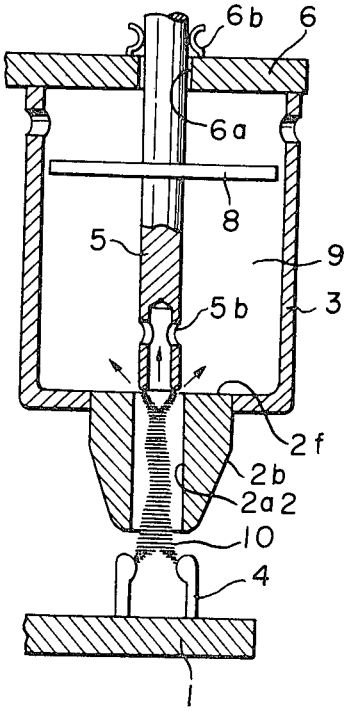

In FIGS. 5 to 7 the other embodiment of the present invention are shown. In the embodiment, the opening **(5*c*) is formed at the end surface of the shaft type second contact (5) and a side hole (5*b*) for connecting to the opening is formed to form the suction guide by the opening (5*c*) and the side hole (5*b*). Until reaching the side (5*b*) to the end surface (2*f*) of the nozzle (2*b*) by the shift of the shaft type second contact (5) as shown in FIG. 6, the effective sectional area of the suction guide is the narrow space formed by the inner surface ($2a_2$) of the nozzle and the outer surface of the shaft type second contact (5), and accordingly, it does not affect to the arc. When the suction guide is enlarged by passing the side hole (5*b*) through the end surface (2*f*) of the nozzle as shown in FIG. 7** after reducing the pressure in the suction chamber, the arc-extinction by sucking the arc is performed.

FIGS. 8 to 13 show the other embodiment of the present invention. The reference (1) designates a terminal plate held on the stationary part (not shown); (2) designates a stationary casing fixed to the terminal plate at the one end and an insulating nozzle **(2*b*) having tapered part (2*a*) which is outwardly expanded is formed at the other end of the cylinder (2). A cylinder (3) for the negative pressure device is connected to end surface of the casing (2) at the insulating nozzle (2*b*). The reference numeral (4) designates the first contact fixed to the terminal plate (1); (5) designates the shaft type second contact which is slidably fitted to the insulating nozzle (2*b*) of the casing (2) to be detachable to the first contact by the driving device (not shown) and the other end of the second contact (5) is slidably fitted to the through-hole (6*a*) of the terminal plate (6) and is electrically connected through the collector (6*b*) fixed to the terminal plate (6). When the contacts (4), (5) are brought into contact, a cold gas storage chamber (7) is formed by the stationary casing (2) and the contacts (4), (5)**.

A piston (8) which is slidably contacts with the cylinder (3) is fixed to the shaft type contact (5). A suction chamber (9) is formed by the piston (8), the cylinder (3)

and the casing (2). The volume of the suction chamber is increased by the detaching operation of the first and second contacts (4), (5) so as to form a negative pressure. The storage chamber (7) is directly connected through the tapered part (2*a*) of the insulating nozzle (2*b*) to the suction chamber (9) so as to form the suction guide.

The current interrupter having said structure is held in a vessel (not shown) filled with $SF_6$ gas.

Figure 8:
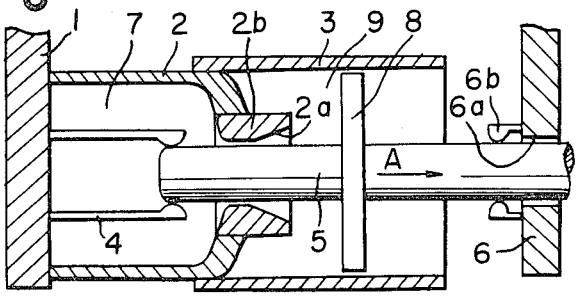
FIGS. 8 to 10 are sectional views of the other embodiment of the current interrupter of the present invention.
Figure 9:
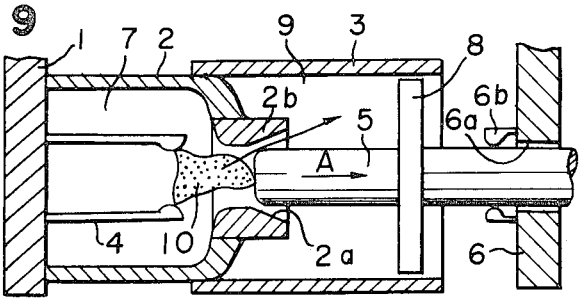
Figure 10:
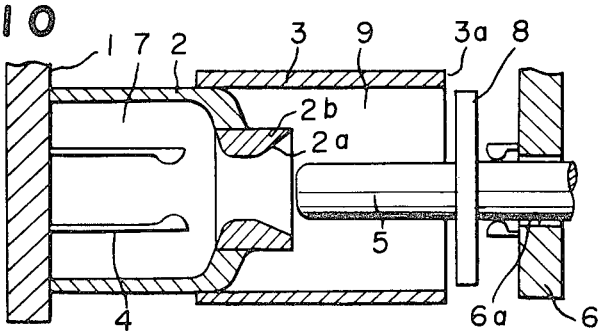

In the current interrupter having said structure, when the second contact (5) is slidably shifted to the arrow line direction A by the driving device (not shown) so as to break the electrical passage of the contacts (4), (5) in the closed state as shown in FIG. 8, an arc (10) is formed between the contact (4) and the end surface of the shaft type contact (5) as shown in FIG. 9. When the second contact (5) is driven, the piston (8) is also shifted to increase the volume of the suction chamber (9) whereby the negative pressure is given. On the other hand, the gas in the storage chamber (7) is compressed by the arcing to increase the pressure. The end of the second contact (5) reaches to the nozzle (2*b*) at the end of the stationary casing (2) and the gas is discharged from the storage chamber (7) through the arc (10) and the suction guide as the tapered part (2*a*) into the suction chamber (9). The arc (10) is cooled by the gas and the arc-extinction is performed. The arc extinction state is shown in FIG. 10.

Figure 11:
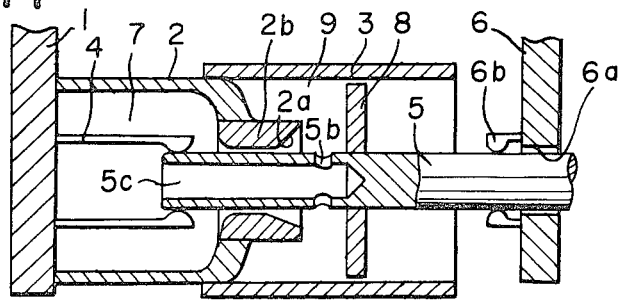
FIG. 11 is a sectional view of the other embodiment of the current interrupters of the present invention.

FIG. 11 shows the other embodiment of the present invention. The storage chamber (7) is connected to the suction chamber (9) through the opening (5*c*) formed at the axial center of the second contact (5) and the side hole (5*b*) connected to the opening beside the suction guide for connecting the storage chamber (7) through the nozzle tapered part (2*a*) to the suction chamber (9).

Figure 12:
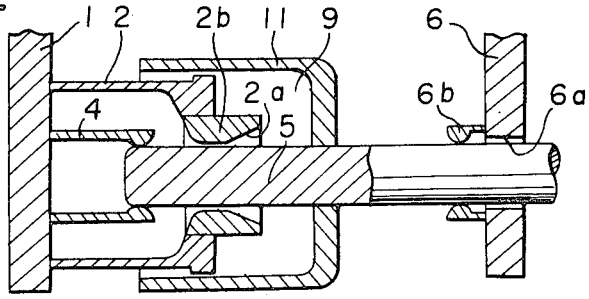
FIG. 12 is a sectional view of the other embodiment of the current interrupter of the present invention.

FIG. 12 shows the other embodiment of the present invention. One end surface of the stationary casing (2) is used for the piston and the cylinder (11) is fixed to the second contact (5).

Figure 13:
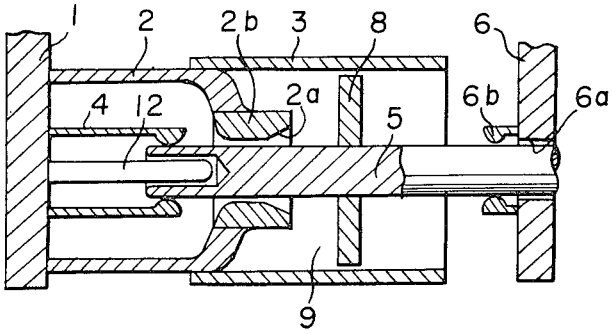
FIGS. 13, 14, 15 and 16 are sectional views of the other embodiment of the current interrupter of the present invention.

FIG. 13 shows the other embodiment using a third electrode (12) which is used as an arc contact beside the pair of the contacts (4), (5).

In accordance with the present invention, the sucking into the suction chamber (9) is performed by the negative pressure function of the negative pressure device even though the energy caused by the arcing is too small to rise the pressure of the gas in the storage chamber (7) in the case of a small current cut-off whereby the gas can be rapidly puffed from the storage chamber (7) and the arc-extinction characteristic in the small current cut-off can be remarkably improved.

After the completion of the cut-off operations, the hot gas remained in the storage chamber (7) and the suction chamber (9) is discharged through the connection between the end part (3*a*) of the cylinder (3) and the piston (8) as shown in FIG. 10. The breakdown strength between the contacts (4), (5) is increased to maintain high breakdown voltage.

In said embodiment, when the end of the movable contact (5) is passed through the nozzle (2*b*), the storage chamber (7) is connected to the suction chamber (9). As shown in FIg. 11, the storage chamber (7) can be previously connected to the suction chamber (9) through the opening (5*c*) and the side hole (5*b*) formed in the movable contact (5).

Figure 14:
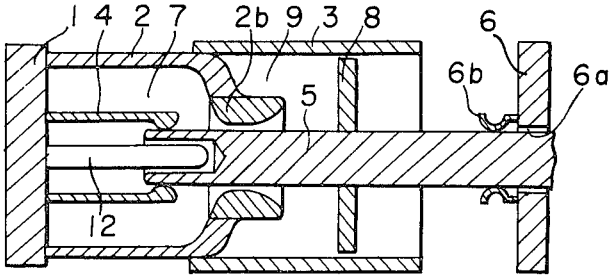

As shown in FIG. 14, the other arc contact (12) can be formed on the terminal plate (1) so as to perform the arcing between the contact (12) and the second contact (5) without any deterioration of the effect.

Figure 15:
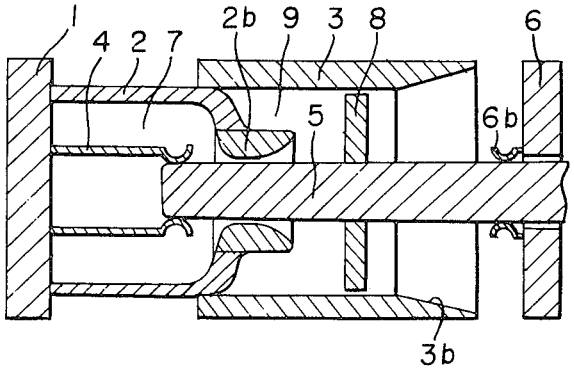

As shown in FIG. 15, the tapered part (3*b*) can be formed in the cylinder (3) as the means for releasing the fitting of the piston (8) and the cylinder (3) so as to gradually release the fitting of the piston.

Figure 16:
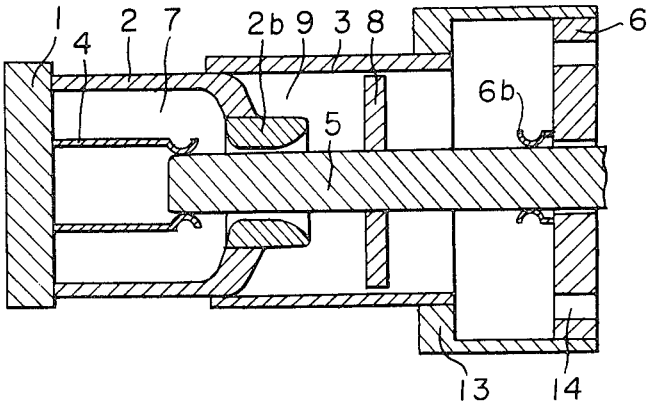

As shown in FIG. 16, the inner diameter of the cylinder (3) can be stepwise enlarged by the subcylinder (13) connected to the end of the cylinder and the gas can be discharged through the throughhole (14) formed in the terminal plate (6) to the atmosphere.

In the embodiments, the connection between the cylinder and the atmosphere is formed by the shifting of the piston forming the negative pressure device. The same effect can be expected by the structure shown in FIG. 12 wherein the cylinder (11) is fixed on the movable contact (5) and the end surface of the stationary casing (2) is used for the piston and the suction chamber (9) is connected to the atmosphere when the cylinder (11) is detached from the stationary casing (2).

In FIGS. 17 to 20, the reference numeral (1) designates the terminal plate held on the stationary part (not shown); (2) designates a stationary casing, one end of which is fixed to the terminal plate, and the insulating nozzle (2*b*) having the tapered part (2*a*) which is outwardly expanded, is formed at the other end of the casing (2); (4) designates the first contact fixed to the terminal plate (1); (5) designates the shaft type second contact which is detachable to the first contact by the driving device (not shown) and is slidably fitted to the insulating nozzle (2*b*) into the casing (2) at one end and the other end of the second contact is slidably fitted to the through-hole (6*a*) of the terminal plate (6), and is electrically connected through the collector (6*b*) fixed to the terminal plate (6). When the contacts (4), (5) are closed, the cold gas storage chamber (7) is formed by the stationary casing (2) and the contacts (4), (5).

The cylinder (3) is fixed to the terminal plate (6) and the negative pressure device is formed by the cylinder (3) and the shaft type contact (5) as the piston rod and the piston (8) which slidably contacts with the cylinder (3) is fixed to the shaft type contact (5). The volume of the suction chamber (9) formed by the cylinder (3), the terminal plate (6) and the piston (8) is increased depending upon the detaching operation of the contacts (4), (5) so as to cause the negative pressure.

The opening (5*c*) is formed on the end surface of the shaft type second contact (5) and the side hole (5*b*) connected to the opening is also formed so as to form the arc suction guide by the opening hole (5*a*) and the side hole (5*b*).

A discharge guide (2*c*) is formed in the storage chamber (7) to directly connected through the tapered part (2*a*) of the nozzle (2*b*) of the stationary casing (2) to out of the storage chamber.

The current interrupter having the structure is held in the vessel (not shown) filled with $SF_6$ gas.

Figure 17:
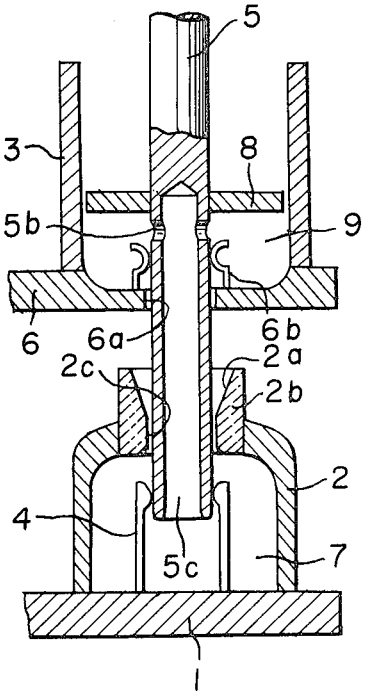
FIGS. 17 to 46 are sectional views of the other embodiments of the current interrupter of the present invention.
Figure 18:
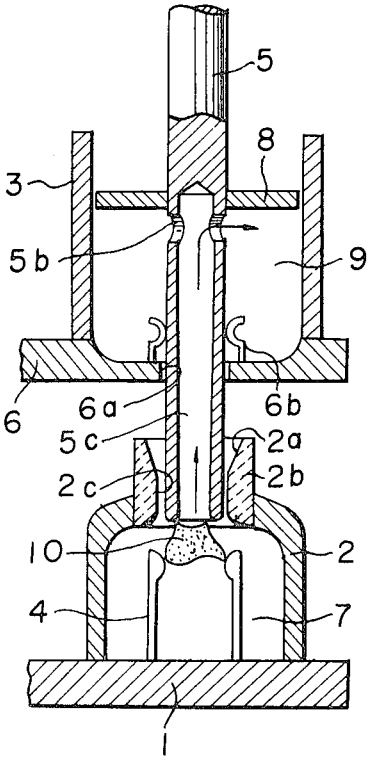
Figure 19:
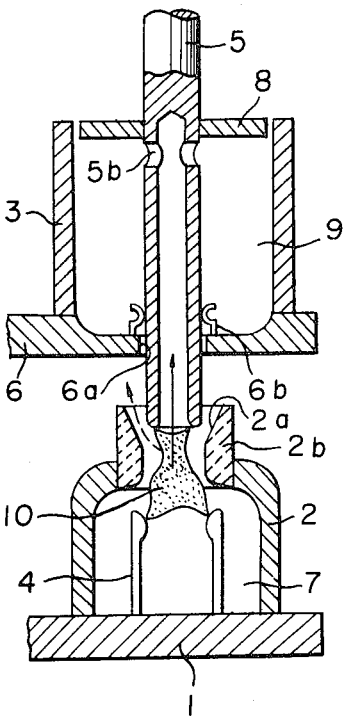
Figure 20:
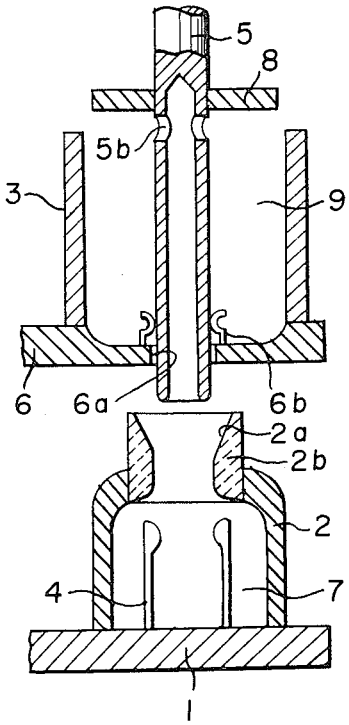

In the current interrupter, when the second contact (5) is upwardly shifted by the driving device (not shown) to cut-off the electric passage of the first and second contacts (4), (5) in the closed state shown in FIG. 17, the arc (10) is formed between the contact (4) and the shaft type second contact (5) as shown in FIG. 18. The piston (8) fixed to the second contact (5) is shifted whereby the volume of the suction chamber (9) is increased to give the negative pressure. As shown in FIG. 18 by the arrow line, the arc is sucked into the suction guide formed by the opening hole (5*c*) and the side hole (5*b*), and simultaneously, the cold gas in the storage chamber (7) is mixed with the arc to perform the arc-extinction. Thus, in the case of a large current cut-off, the suction chamber (9) for the negative pressure is filled with the hot discharged gas to stop the formation of the negative pressure. The cold gas compressed by the arcing in the pressurized storage chamber (7) is discharged out of the storage chamber (7) through the tapered part (2*a*) of the nozzle (2*b*) as shown by the dotted line in FIG. 19 and the arc (10) is cooled by the cold gas to perform the arc-extinction. The state of the completion of the arc extinction is shown in FIG. 20.

Figure 21:
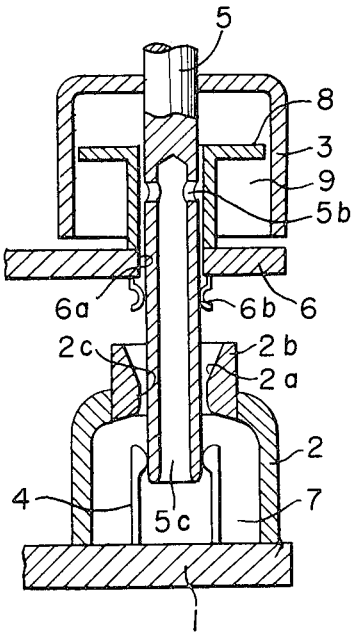
Figure 22:
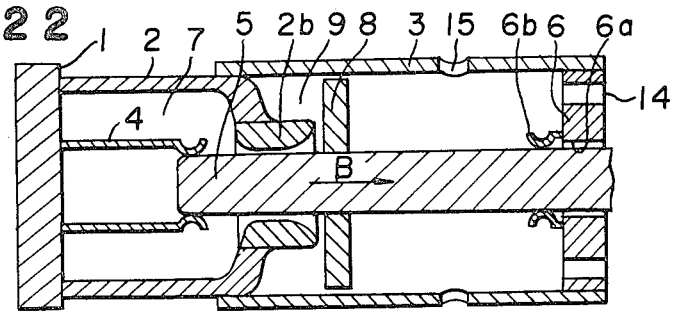

FIG. 21 shows the other embodiment of the present invention. The cylinder (3) of the negative pressure device is fixed to the second contact (5) and the piston (8) is fixed to the terminal plate (6). The same effect as that of the above-mentioned embodiment can be attained by this embodiment.

In accordance with the present invention, even though the energy caused by the arcing is too small to rise the pressure of the gas in the storage chamber (7) so as to be difficult to form the flow caused by the pressure different, the gas can be rapidly discharged from the storage chamber (7) by sucking it into the suction chamber (9). At the time stopping the formation of the negative pressure in the suction chamber (9) caused by the increase of the suction gas in the large current cut-off as the disadvantage of the negative pressure device, the gas is directly discharged from the storage chamber (7) out of the storage chamber and accordingly, excellent breaking characteristic can be advantageously obtained in the case of a large current cut-off.

FIGS. 22 to 25 show the other embodiment of the present invention.

The reference numeral (1) designates the terminal plate; (2) designates the stationary casing; (3) designates a cylinder; (4) designates the first contact; (5) designates the second contact (6) designates the terminal plate; (7) designates the storage chamber; (8) designates the piston; (9) designates the suction chamber; (2*b*) designates the insulating nozzle; (6*b*) designates the collector; and the through-hole (15) connected to the suction chamber (9) is formed in the cylinder (3) and is placed so as to connect to the suction chamber (9) in the stroke of the piston (8) in the cylinder (3).

Figure 23:
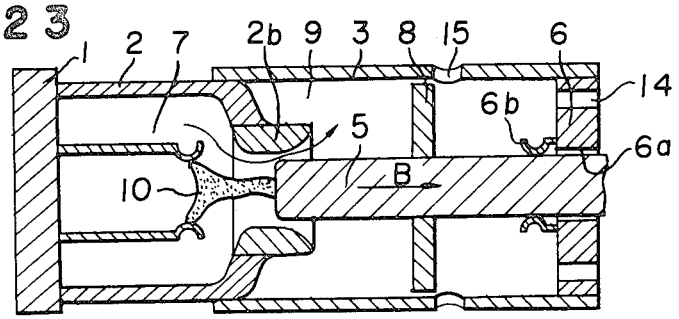
Figure 24:
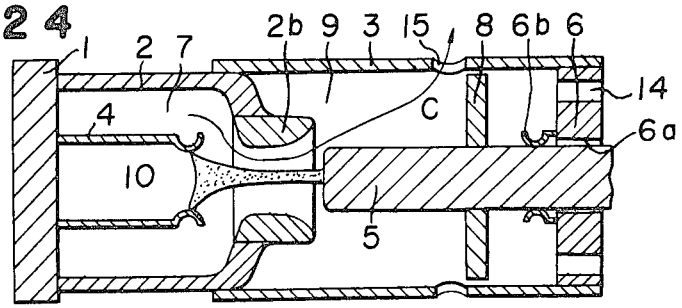

In the current interrupter having the structure, when the second contact (5) is shifted to the arrow line B so as to cut-off the electric passage of the first and second contacts (4), (5) in the closed state, the arc (10) is formed between the contact (4) and the end surface of the shaft type contact (4) as shown in FIG. 23. The piston (8) is shifted by the driving of the second contact (5) whereby the volume of the suction chamber (9) is increased to cause the negative pressure. The gas in the storage chamber (7) is compressed by the arcing to rise the pressure. When the end of the second contact (5) reaches to the nozzle (2*b*), the gas in the storage chamber (7) is discharged through the nozzle (2*b*) as the suction guide into the suction chamber (9). The arc (10) is cooled. Thus, the current is rapidly cut-off at the zero point of the current in the case of a small current cut-off.

Figure 25:
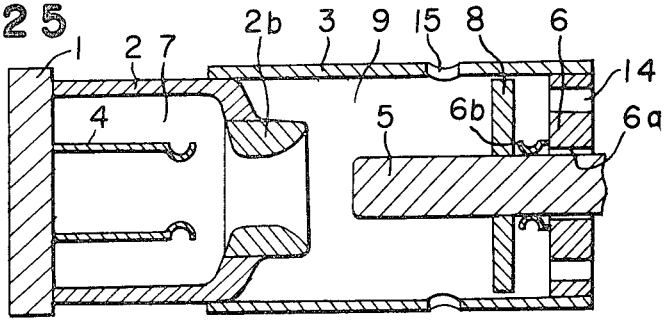

Thus, in the case of a large current cut-off which can not completed by the above-mentioned arc-extinction, the pressure of the gas in the storage chamber (7) is raised by the heat caused by the arcing. When the piston (8) shifted with the contact (5) is passed through the position of the through-hole (15) so as to connect to the suction chamber (9) by the through-hole (15), the gas is discharged to the atmosphere as shown by the arrow line. The arc (10) is cooled by the gas to cut-off the current. After the completion of the current cut-off operation, the hot gas remained in the storage chamber (7) and the suction chamber (9) is discharged through the through-hole (15) as shown in FIG. 25. The breakdown strength between the contacts (4), (5) is increased to maintain high breakdown voltage.

Figure 26:
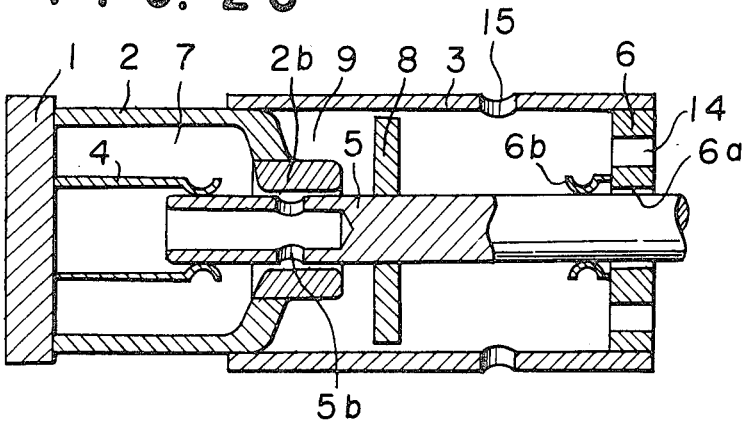

In said embodiment, the storage chamber (7) is connected to the suction chamber (9) after passing the end of the first contact (5) through the nozzle (2*b*). It is also possible to provide the embodiment forming the through-hole (5*b*) in the first contact (5) as shown in FIG. 26 and whereby the storage chamber is connected to the suction chamber (9) when the through-hole passes the nozzle (2*b*).

The breaking parts of the current interrupters shown in FIGS. 27 to 31 are respectively held in the vessel (not shown) filled with the gas as $SF_6$ gas.

The terminal plate (1) fixed to the stationary part (not shown) supports the stationary casing (2) and the first contact (4) stationary contact). The end of the stationary casing (2) at the rear side to fix the terminal plate (1) is connected to the cylinder (3) for the negative pressure device and has the insulating nozzle (2*b*) on the end surface. The second contact (5) being detachable to the first contact (4) in the stationary casing (2) slidably shifted in the insulating nozzle (2*b*). The other end of the second contact is slidably shifted through the through-hole (6*a*) of the terminal plate (6) and is electrically connected to the collector (6*b*). When the second contact (5) and the first contact (4) are in the closed state in the stationary casing (2), the gas storage chamber (7) is formed by the contacts and the casing and the piston (8) fitted to the cylinder (3) is fixed and the suction chamber (9) is of the negative pressure device is formed by the cylinder (3) and the piston (8). FIGS. 27 to 30 show the embodiments wherein the suction guide for connecting the storage chamber (7) in the stationary casing (2) to the suction chamber (9) of the negative pressure device is formed by the through-hole (5*c*) and the side hole (5*b*) in the second contact and FIG. 5 shows the embodiment wherein the suction guide is formed by the inner wall (2*c*) of the insulating nozzle (2*b*) and the nozzle tapered part (2*d*). In both cases, the sectional are of the suction guide is varied depending upon the detaching operation of the contacts.

Figure 27:
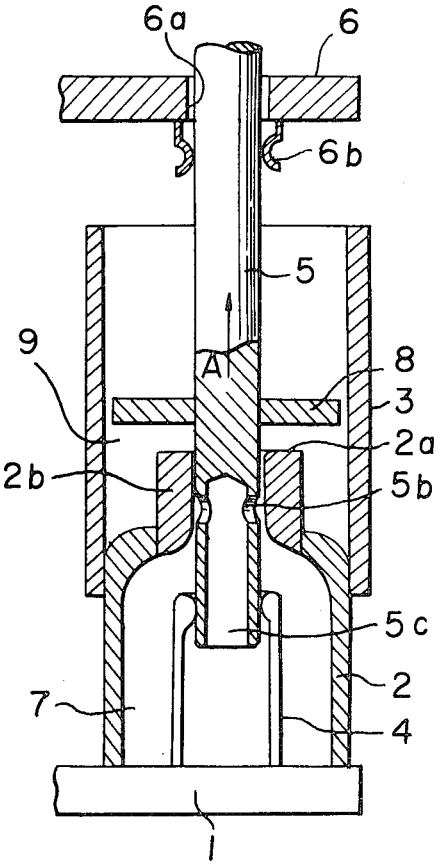
Figure 28:
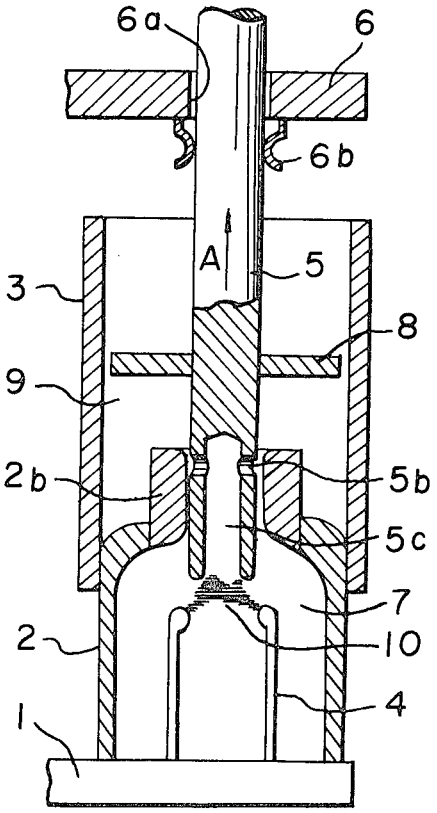

In the current interrupter having the structure, when the second contact (5) in the first and second contacts (4), (5) in the closed state as shown in FIG. 27, is driven to the arrow line A, the arc (10) is formed between the first and second contacts being detached as shown in FIG. 28. When the second contact (5) is shifted to the arrow line A, the piston (8) fixed to the contact is also shifted, to the same direction together with the contact whereby the volume of the suction chamber (9) formed by the cylinder (3), the end wall of the stationary casing and the piston is increased to give the negative pressure. On the other hand, the gas in the storage chamber (7) is heated by the arcing so as to rise the pressure.

Figure 29:
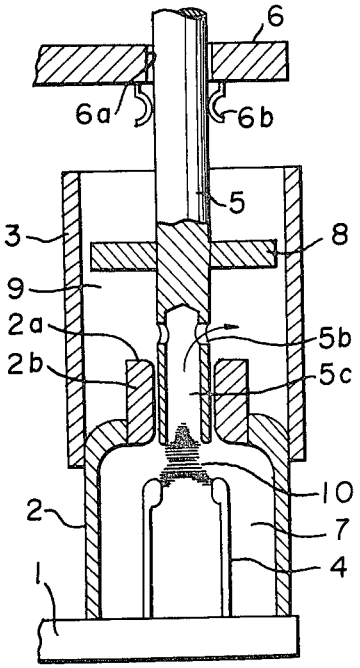
Figure 30:
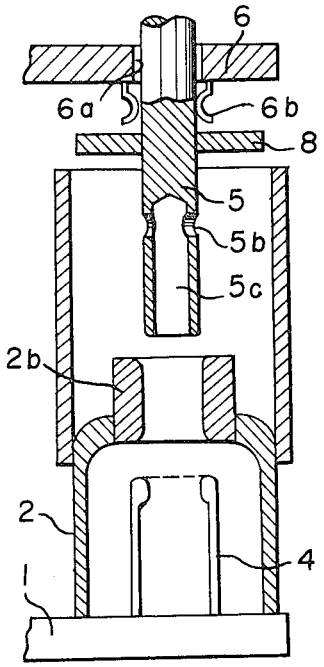

As shown in FIG. 29, the second contact (5) is shifted further to reach the end of the second contact (5) to the insulating nozzle (2*b*) at the one end of the stationary casing (2) and to pass the side hole (5*b*) of the contact through the end surface (2*a*) of the insulating nozzle (2*b*), whereby the compressed gas in the storage chamber (7) is discharged through the arc (10), the through-hole (5c) and the side hole (5b) into the suction chamber (9) kept in a satisfactorily negative pressure. The arc (10) is cooled by the gas to complete the arc-extinction. The state of the completion of the cut-of is shown in FIG. 30.

Figure 31:
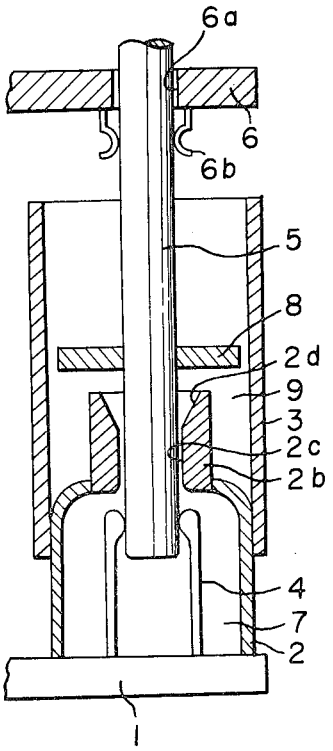

In the embodiment shown in FIG. 31, when the end of the second contact (5) is passed through the tapered part (2d) of the insulating nozzle (2b), the sectional area of the suction guide formed by the tapered part (2d) and the end of the second contact is varied to gradually increase.

In accordance with the embodiment, the negative pressure can be effectively utilized under the variation of the gas discharged into the suction chamber (9) depending upon the time variation of the sectional area of the opening so as to easily attain the small current cut-off even though the energy caused by the arcing is too small to rise the gas pressure in the storage chamber (7) in the case of a small current cut-off.

In the embodiment, the stationary casing is fixed to the cylinder of the negative pressure device. It is also possible to modify it to use the stationary casing as the piston by slidably shifting the cylinder.

In the embodiment, the second contact is shifted with the piston of the negative pressure device. It is possible to modify it to shift the contact with the cylinder.

The current interrupter equipped with the negative pressure device shown in FIGS. 8 to 10 has the above-mentioned structure to impart the effect in some extent. Thus, when the current for cut-off is too large, the suction under the negative pressure is not enough as the energy of the arcing is large whereby much energy is remained in the storage chamber (7) even at the current zero point to be difficult to perform the cut-off. The hot gas is remained in the storage chamber (7) and the suction chamber (9) even after the cut-off, whereby sometimes the insulation breakdown is caused by high voltage applied between the contacts (4), (5) so as to cause the passing of the current again.

The following embodiment is to overcome the disadvantage.

FIGS. 32 to 36 show the embodiments of the current interrupter which imparts a large current cut-off by improving the arcing energy removing characteristic under interlocking two or more negative pressure devices.

Figure 32:
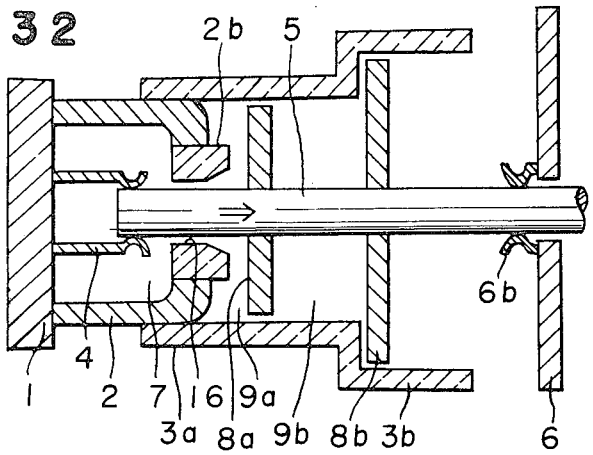
Figure 34:
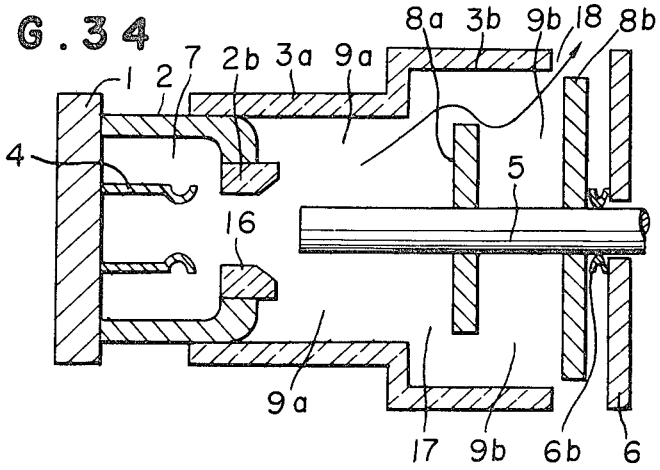

In FIGS. 32 and 34, the reference number (1) designates the terminal plate fixed to the stationary part; (2) designates the stationary casing fixed to the terminal plate (1) at one end; (2b) designates the insulating nozzle plated at one end of the stationary casing (2); (4) designates the stationary contact fixed on the terminal plate (1); (5) designates the movable contact which is detachable to the stationary contact (4) and is connected to the driving device (not shown) and is electrically connected through the collector (6b) to the terminal plate (6); (3a) and (3b) designate cylinders made of an insulating material which arefixed to one end of the stationary casing (2) and are formed in one piece to have different diameters of the cylinders; (8a) and (8b) designate first and second pistons which are respectively slidable in the corresponding cylinders (3a), (3b) and are fixed to the movable contact (5); (7) designates the arc-extinction gas storage chamber formed by the terminal plate (1), the stationary casing (2), the insulating nozzle (2b) and the movable contact (5) in the closed state; (9a) designates a first suction chamber formed by the insulating nozzle (2b), the cylinder (3a) and the first piston (8a); (9b) designates a second suction chamber formed by the cylinders (3a), (3b) and the first pistons (8a), (8b); (16) designates a guide which is closed by closing the movable contact (5) and connects the storage chamber (7) to the first suction chamber (9a) by detaching the movable contact; (18) designates a connection passage for connecting the second suction chamber (9b) to the vessel filled with $SF_6$ gas for the arc-extinction (not shown).

The operation of the embodiment will be illustrated.

As shown in FIG. 32, when the stationary contact (4) and the movable contact (5) are closed, the current is passed through an electric passage formed by the terminal plate (1), the stationary contact (4), the movable contact (5), the collector (6b) and the terminal plate (6).

Figure 33:
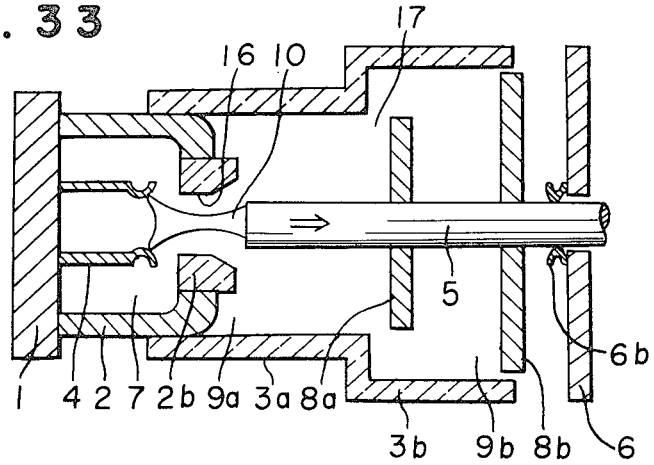

When a relatively small current cut-off is performed, the arc (10) is formed between the stationary contact (4) and the movable contact (5) as shown in FIG. 33 by shifting the movable contact (5) to the arrow line by the driving device (not shown). The storage chamber (7) is filled with the hot and pressurized gas formed by the arc (10). On the other hand, when the movable contact (5) is driven, the first and second pistons (8a), (8b) which are fixed to the movable contact (5) are respectively slidably shifted in the cylinders (3a), (3b) whereby the volumes of the first suction chamber (9a) and the second suction chamber (9b) are increased from the time closing the stationary contact (4) and the movable contact (5) and the pressure in the first and second suction chambers (9a),(9b) are decreased to cause the negative pressure. When the end of the movable contact (5) reaches to the end surface of the nozzle (2b), the gas is discharged from the storage chamber (7) through the arc (10) to the first suction chamber (9a) whereby the arc is elongated and cooled and the current is rapidly cut-off.

In the case of a large current cut-off the energy of the arc is large and the energy fed into the first suction chamber (9a) is large. Thus, during the detaching operation of the movable contact (5), the passage for connecting the first suction chamber (9a) to the second suction chamber (9b) is formed whereby the hot gas discharged into the first suction chamber (9a) is further sucked and discharged into the suction chamber (9b). Therefore, the capacity for absorbing the arc energy is increased to effectively cool the arc (10) whereby the large current cut-off can be easily performed. After the completion of the cut-off operation, the passage (arrow line) of the first suction chamber (9a), the passage (17), the second suction chamber (9b), the passage (18) and the atmosphere is formed as shown in FIG. 34, whereby the breakdown voltage between the stationary contact (4) and the movable contact (5) is increased to perform the large current cut-off without failure, without any reexcitation after the current cut-off.

Figure 35:
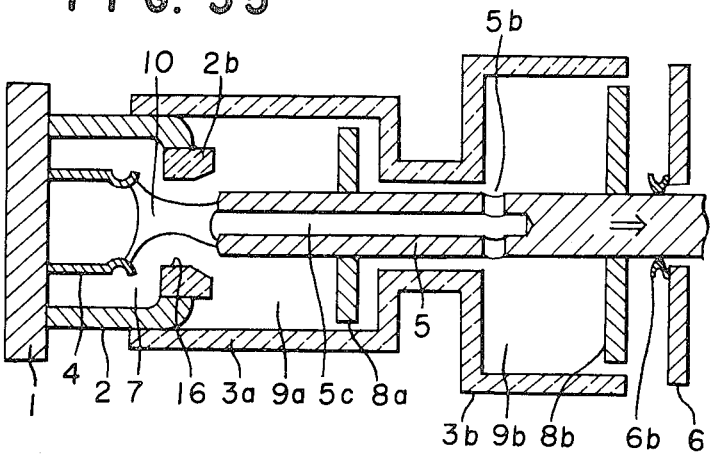

FIG. 35 shows a sectional side view of the other embodiment beside the embodiments shown in FIGS. 32 to 34 to illustrate the operation condition.

In FIG. 35, the same reference numerals designate the identical or corresponding parts. The detail description is eliminated, The embodiment is different from that of FIG. 33 as follows. The through-hole (5b) connecting the movable contact (5) to the second suction chamber (9b) is formed whereby the hot gas formed by the arcing is firstly discharged into the first suction chamber (9a) and during the detaching of the movable contact (5), a passage connecting the first suction chamber (9a) through the passage (5b) to the second suction chamber (9b) is formed and the hot gas is effectively discharged into the first and second suction chambers (9a),(9b) to cut-off a large or small current.

Figure 36A:
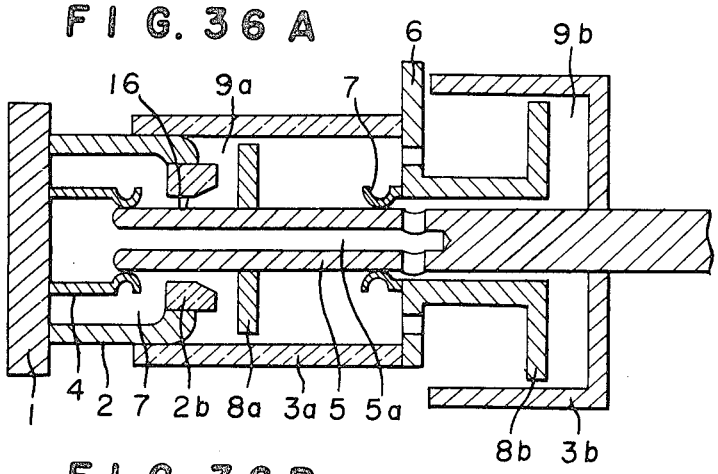
Figure 36B:
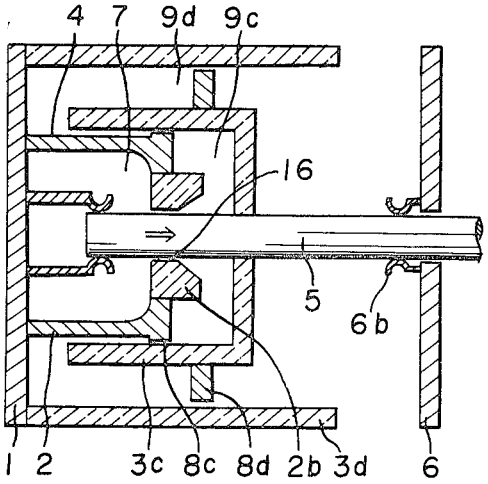

FIG. 36 shows the other embodiment of the present invention. The same reference numbers of FIG. 35 designate the identical or corresponding parts. The embodiment is different from that of FIG. 35 as follows. The piston (8b) for forming the second suction chamber (9b) is fixed to the terminal plate (6) so as to interlock the cylinder (3b) to the movable contact (5). The current cut-off operation is the same as that of FIG. 35 and the cut-off of a small current or a large current is effectively performed.

Figure 37:
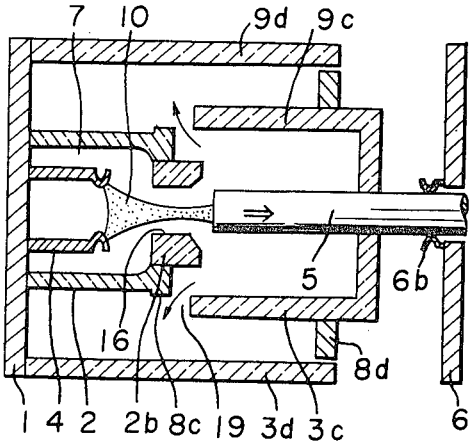
Figure 38:
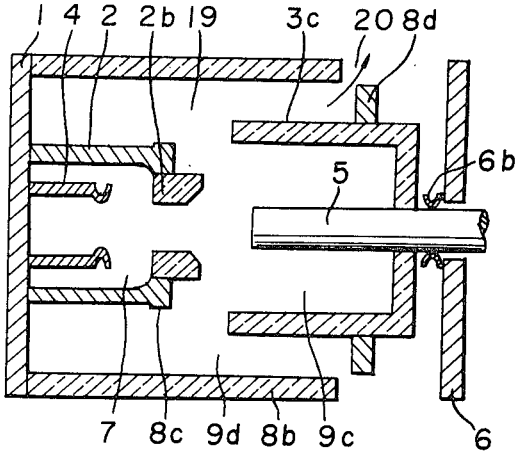
Figure 39:
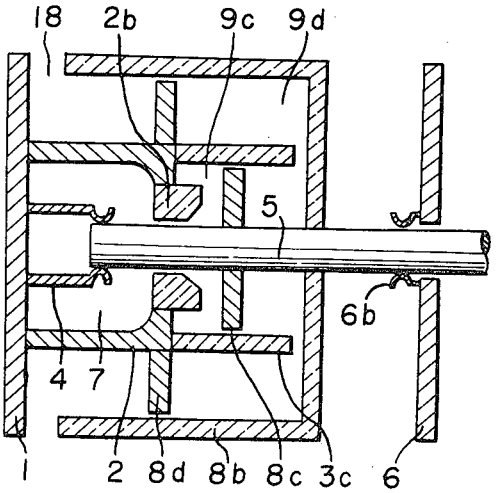

FIGS. 36 to 39 show the other embodiments. In FIGS. 36 to 38, the reference numeral (1) designates the terminal plate fixed to the stationary part; (2) designates the stationary casing fixed to the terminal plate (1); (2b) designates the insulating nozzle formed at one end of the stationary casing (2); (4) designates the stationary contact fixed to the terminal plate (1); (5) designates the movable contact which is detachable to the stationary contact (4) and is driven by the driving device (not shown) and is electrically connected through the collector (6b) to the terminal plate (6); (3c) designates a first cylinder fixed to the movable contact (5); (3d) designates a second cylinder which is coaxially projected out of the stationary casing (2) and is fixed to the terminal plate (1); (8c) designates a first piston which is fixed to one end of the stationary casing (2) to slidably shift in the first cylinder (3c); (8d) designates a second piston which is directly formed on the first cylinder (3c) extending to the radical direction on the outer surface to slidably shift in the second cylinder (3d); (7) designates the storage chamber for $SF_6$ gas as the arc-extinction gas which is formed by the terminal plate (1), the stationary casing (2), the insulating nozzle (3) and the movable contact (5) in the closed state; (9c) designates the first suction chamber formed by the first piston (8c), the insulating nozzle (2b) and the first cylinder (3c); (9d) designates the second suction chamber which is formed by the terminal plate (1), the first cylinder (3c), the second cylinder (3d) and the second piston (8d) and which is coaxially placed to the first suction chamber (9c); (16) designates the guide which is closed by the closing of the movable contact (5) and connects the storage chamber (7) to the first suction chamber (9c) by the detaching of the movable contact (5); (19) designates a passage for connecting the first suction chamber (9c) to the second suction chamber (9d) by the detaching of the contacts (4), (5); and (18) designates a passage for connecting the second suction chamber (9d) to the vessel filled with $SF_6$ gas (not shown).

The operation of the embodiment will be illustrated.

In the state of the closing of the contacts (4), (5) as shown in FIG. 36, the current passes the electrical passage formed by the terminal plate (1), the stationary contact (4), the movable contact (5), the collector (6b) and the terminal plate (6). In the case of a relative small current cut-off, the arc (10) is formed between the stationary contact (4) and the movable contact (5) as shown in FIG. 37 by driving the movable contact (5) to the arrow line direction by the driving device (not shown). The storage chamber (7) is filled with the hot and pressurized gas by the arcing. On the other hand, the first cylinder (3c) which is fixed to the movable contact (5) is interlocked to the second cylinder (8d) by shifting the movable contact. The volumes of the first suction chamber (9c) and the second suction chamber (9d) are increased by the closing of the contacts (4), (5) whereby the pressure in the first suction chamber (9c) and the second suction chamber (9d) is decreased to give the negative pressure. When the end of the movable contact begins to detach the end of the insulating nozzle (3) in the detaching operation of the movable contact (5), the gas stored in the storage chamber (7) is rapidly discharged through the guide (16), and the arc (10) space into the first suction chamber (9c) to cool the gas and to perform the arc-extinction. In the case of further large current cut-off, the arc energy is increased to increase the energy discharged into the first suction chamber (9c). During the detaching of the movable contact (5), a passage (19) for connecting the first suction chamber (9c) to the second suction chamber (9d) is formed to suck the gas from the first suction chamber (9c) into the second suction chamber (9d) whereby the arc energy is effectively eliminated to attain the large current cut-off. After the completion of the current cut-off operation, the hot gas is discharged through the passage (20) for connecting the first suction chamber (9c) and the second suction chamber (9d) to the atmosphere as shown in FIg. 38 to the arrow line direction. The breakdown voltage between the stationary contact (4) and the movable contact (5) is increased to perform the cut-off without failure without any reexcitation after the large current cut-off.

In said embodiment, the first suction chamber (9c) is formed by the first piston (8c) fixed to the stationary casing and the first cylinder (8a) fixed to the movable contact (5). The second suction chamber (9d) is formed by the second piston (8d) fixed on the outer surface of the first cylinder and the second cylinder (3d) fixed on the terminal plate (1). It is possible to form as the embodiment shown in FIG. 39 wherein the first suction chamber (9c) is formed by the first cylinder (3c) fixed to the stationary casing (2) and the first piston (8c) fixed to the movable contact (5) and the second suction chamber (9d) is formed by the second cylinder (3d) fixed to the movable contact (5) and the second piston (8d) fixed on the outer surface of the stationary casing (2) which is the same surface of the cylinder (3c) in the embodiment of FIG. 39 which is the outer surface along the first cylinder (3c).

The other embodiment of the present invention will be illustrated. In FIGS. 40 to 43, the reference numeral (1) designates the terminal plate fixed; (2) designates the stationary casing which is fixed to the terminal plate (1) at one end and connects the insulating nozzle (2b) at the other end; (4) designates the stationary arc contact fixed to the terminal plate (1); (5) designates the movable arc contact which is detachable to the stationary arc contact (4) and is connected to the driving device (not shown) and is electrically connected through the collector (6b) to the terminal plate (6); (8) designates the piston formed in one piece with the stationary casing (2); (20) designates a stationary main contact fixed to the stationary casing (2); (21) designates a main movable contact which is fixed to the movable arc contact (2) in one piece and is detachable to the stationary main contact (20) and has an insulating cylinder (3c) being slidable to the piston (8) at the end; (7) designates the arc-extinction gas storage chamber formed by the terminal plate (1), the stationary casing (2), the insulating nozzle (2b) and the movable arc contact (5) in the closed state; (9) designates the suction chamber formed by the cylinder (3c), the movable main contact (21) and the insulating nozzle (2*b*); (16) designates the guide for connecting the storage chamber (7) to the suction chamber (9) and the guide is formed by the opening of the insulating nozzle (2*b*). The size of the wiping between the stationary arc contact (4) and the movable arc contact (5) is larger than the size of the wiping between the stationary main contact (20) and the movable main contact (21).

Figure 40:
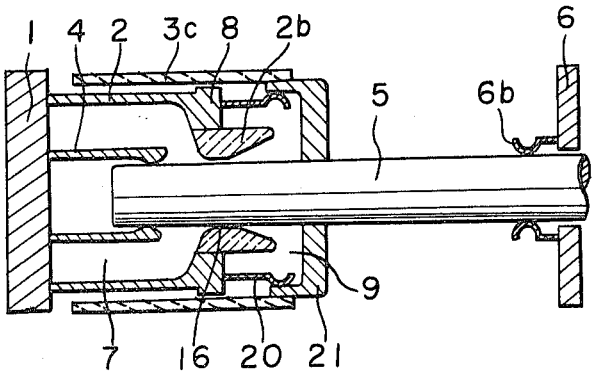
Figure 41:
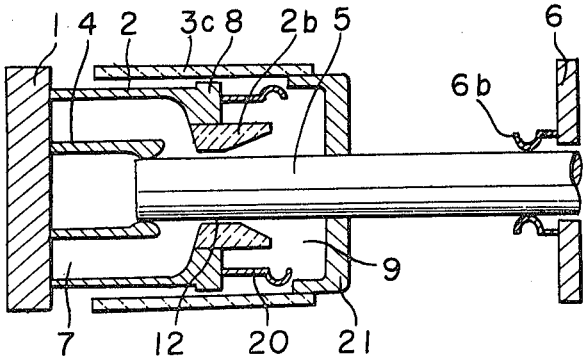
Figure 42:
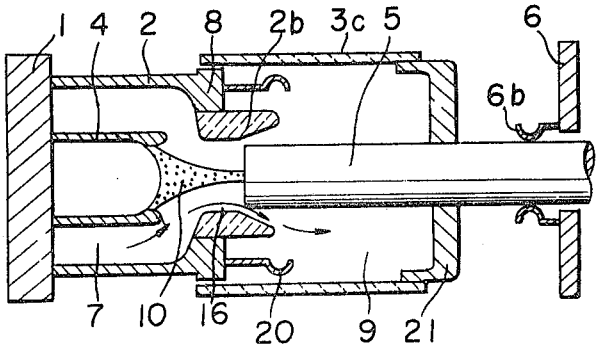
Figure 43:
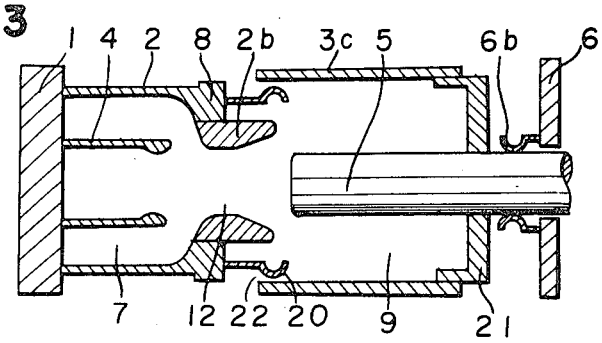

The operation of the embodiment will be illustrated. As shown in FIG. 40 when the driving device (not shown) is actuated in the contacts are closed to pass the current, the movable main contact (21) fixed to the movable arc contact (5) is shifted to the right direction. Thus, the wiping size is different whereby the stationary and movable main contacts (20), (21) are detached as shown in FIG. 41, however, the stationary and movable arc contacts (4), (5) are still contacted to pass the current and no arc is formed between the stationary and movable main contacts (20), (21). When the movable arc contact (5) is further shifted to detach from the stationary arc contact (4), the arc (10) is formed between the contacts. The cylinder (3*c*) is also slidably shifted to the piston (8) to the right direction whereby the volume of the suction chamber (9) is increased to reduce the gas pressure in the chamber. The gas is discharged from the storage chamber (10) into the suction chamber (11) by connecting the storage chamber (10) to the suction chamber (11) under passing the end of the movable arc contact (5) through the guide of the insulating nozzle whereby the arc (10) in the guide is cooled to cut-off the current at the current zero point as shown in FIG. 43.

Figure 44:
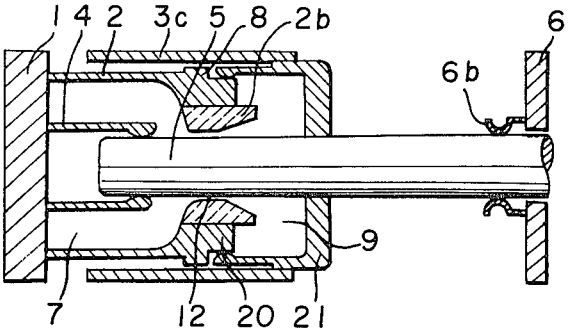
Figure 45:
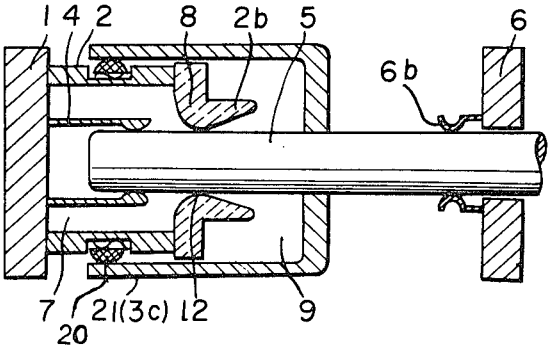

In the embodiment, the pressure for contacting the main contacts (20), (21) is imparted by a resilient material of the stationary main contact (20). It is possible to impart the resilient property to the movable main contact (21) as shown in FIG. 44. It is also possible to use the movable main contact (21) as the cylinder by using the piston (8) made of an insulating material as shown in FIG. 45.

Figure 46:
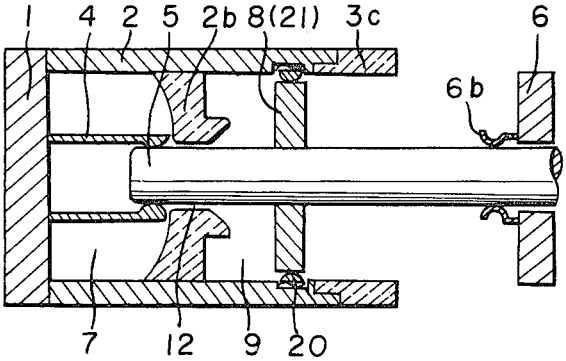

In said embodiment, the cylinder (3*c*) is fixed to the movable main contact (21). The same effect can be attained by fixing the cylinder (3*c*) to the stationary casing and fixing the piston (8) to the movable contact (21). In the embodiment shown in FIG. 46, the piston (8) is also used for the movable main contact (21).

Figure 47:
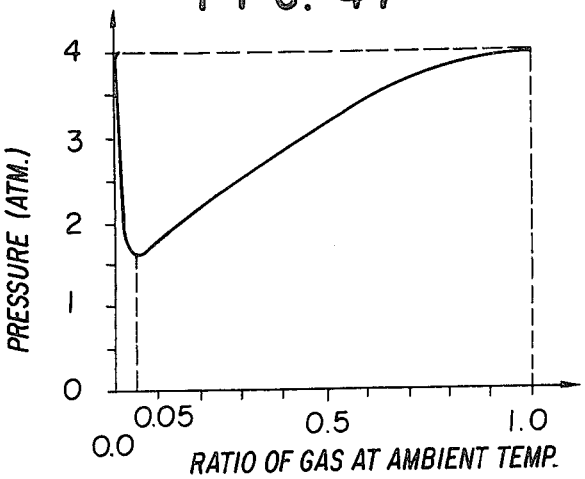
FIG. 47 is a graph for a characteristic curve (pressure to ratio of a gas at the ambient temperature) for one embodiment of the present invention.

FIG. 47 is a characteristic diagram for illustrating the other embodiment. The principle of the embodiment will be illustrated by referring to FIG. 47.

When a gas is separately placed in two parts at the same pressure but different temperature, the temperature and pressure of the gas after completely mixing them in one vessel having a constant volume can be calculated from the densities and the inner energies in the original states of the gas. FIG. 47 shows the result of the calculation of the pressure of the $SF_6$ gas after mixing the gases at the ambient temperature (300° K.) and at high temperature (6000° K.) to the ratio of the mixed gas from the original $SF_6$ gas at 4 atm. As it is understood from the result, the pressure is reduced after mixing them and the reduction is the maximum at the ratio of the gas at the ambient temperature of 5%. This principle is given regardless of the temperature of the hot gas and the kind of the gas.

The other embodiment of the present invention will be illustrated.

Figure 48:
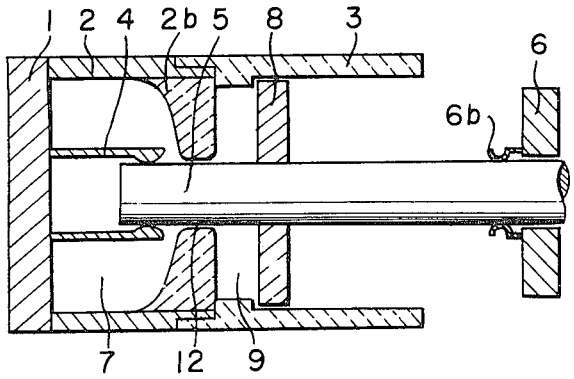
Figure 49:
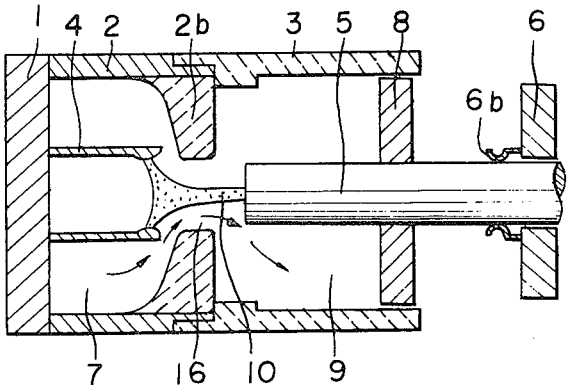
Figure 50:
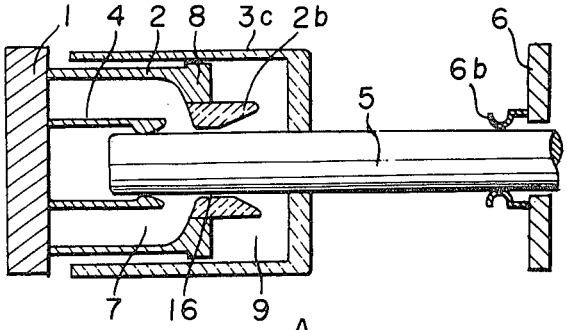

In FIGS. 48 and 49, the reference numeral (1) designates the terminal plate; (2) designates the stationary casing which is fixed to the terminal plate (1) at one end and is fixed to the insulating nozzle (2*b*) and the insulating cylinder (8) at the other end; (4) designates the stationary contact fixed to the terminal plate (1); (5) designates the movable contact which is detachable to the stationary contact (4) and is driven by the driving device (not shown) and is electrically connected through the collector (6*b*) to the terminal plate (6); (8) designates the piston formed in one piece with the movable contact (5) to slidably shift in the cylinder (3); (7) designates the arc-extinction gas storage chamber for $SF_6$ gas which is formed by the terminal plate (1), the stationary casing (2); the insulating nozzle (2*b*) and the movable contact (5) in the closing; (9) designates the suction chamber formed by the cylinder (3) and the piston (8) to connect through the guide (16) to the storage chamber (7). The volume of the storage chamber in the closed state shown in FIG. 48 is more than 5% of the maximum volume. The apparatus is held in a vessel filled with $SF_6$ gas.

The operation of the embodiment will be illustrated. As shown in FIG. 48, when the driving device (not shown) is actuated in the closed state of the contacts (4), (5) to pass the current, the movable contact (5) is shifted to the right direction to detach from the stationary contact (4) and the arcing is formed in the gap between the contacts. During this operation, the piston (8) fixed to the movable contact (5) is slidably shifted in the cylinder (3) to the right direction. The volume of the suction chamber (11) is increased to reduce the pressure of the $SF_6$ gas in the suction chamber (11). The $SF_6$ gas is discharged from the storage chamber (7) into the suction chamber (9) by passing the end of the movable contact (5) through the guide (16) of the insulating nozzle (2*b*) as shown in FIG. 45 whereby the arc (10) is cooled in the guide (16). The $SF_6$ gas discharged into the suction chamber (9) is heated by the arcing to the high temperature of 6000° K. and the hot gas is mixed with the gas at the ambient temperature remained in the suction chamber (9). The pressure in the suction chamber (9) is reduced at lower than the pressure in the storage chamber (7). The reduction rate of the pressure is increased upon decreasing the ratio of the mixed gas to 5% and accordingly, the pressure difference is further increased and a larger amount of the $SF_6$ gas is puffed to the arc to result easy current cut-off.

In this embodiment, the piston (8) is fixed to the movable contact. The same effect can be attained by fixing the cylinder (3) to the movable contact (5) and fixing the piston (8) to the stationary casing (2).

The other embodiment of the present invention will be illustrated.

Figure 51:
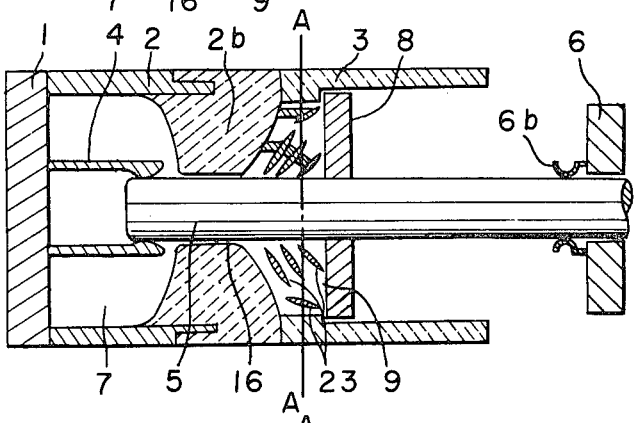
Figure 52:
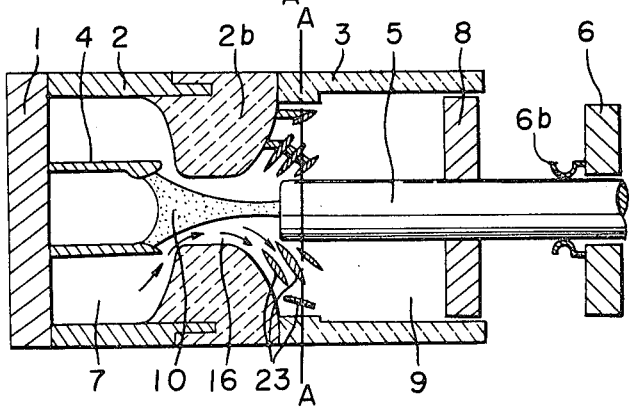
Figure 53:
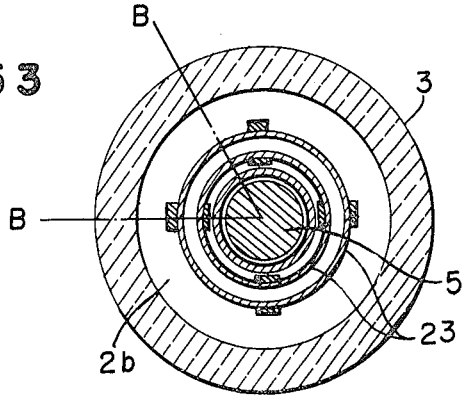

In FIGS. 51 to 53, the reference numeral (1) designates the terminal plate; (2) designates the stationary casing which is fixed to the terminal plate (1) at one end and is fixed to the insulating nozzle (2*b*) and the insulating cylinder (9) at the other end; (4) designates the stationary contact fixed to the terminal plate (1); (5) designates the movable contact which is detachable to the stationary contact (4) and is driven by the driving device and is electrically connected through the collector (6*b*) to the terminal plate (6); (8) designates the piston formed in one piece with the movable contact (5) to slidably shift in the cylinder (3); (7) designates the arc-extinction gas storage chamber for $SF_6$ gas which is formed by the terminal plate (1), the stationary casing (2), the insulating nozzle (3) and the movable contact (5) in the closed state; (9) designates the suction chamber which is surrounded by the cylinder (3) and the piston (8) and is connected through the guide (16) to the storage chamber (7); (23) designates cooling-mixing plates which is fixed to the insulating nozzle (2*b*) at the side of the guide (16) or the guide of the suction chamber (9) and is made of a high heat conductivity such as copper for cooling it and is formed by plying corn type plates with specific gaps for flow-straightening and mixing the arc extinction gas; and (10) designates the arc formed between the contacts (4),(5).

The operation of the embodiment will be illustrated.

As shown in FIG. 51, the contacts (4),(5) are closed and the driving device (not shown) is driven under passing the current, the movable contact (5) is shifted to the right direction to detach from the stationary contact (4) to form the arcing between the gap.

During the operation, the piston (8) fixed to the movable contact (5) is slidably shifted in the cylinder (3) to the right direction. The volume of the suction chamber (9) is increased to decrease the pressure of $SF_6$ in the suction chamber (9). The movable contact (5) is further moves to pass the end through the guide (16) of the insulating nozzle (2*b*) to connect the storage chamber (7) to the suction chamber (9) as shown in FIG. 52.

The $SF_6$ gas in the storage chamber (7) is discharged into the suction chamber (9) to cool the hot arc (10) in the guide (16) and the gas is heated. The hot gas has high heat conductivity in the feeding into the suction chamber (9) and is passed through the spaces between the cooling-mixing plates (23) having broad surface area. The gas is cooled by the plates (23) and is fed into the suction chamber (9) to thoroughly mix with a cold gas in the suction chamber (9). The temperature and the pressure in the suction chamber (9) are maintained in low levels. Therefore, in the case of the small current cut-off as well as the case of the large current cut-off, the pressure difference between the storage chamber (7) and the suction chamber (9) is maintained in high level and the puffing effect to the arc (10) is high to perform excellent cut-off characteristics.

The cooling-mixing plates (23) are made of a material having high heat conductivity such as copper. It is possible to make it of an insulating material. In such case, the heat conductivity is low whereby the hot gas is cooled by a vaporizing latent heat and the mixing with the cold gas in the suction chamber is thoroughly performed by flow-straightening function to give the same effects. The cooling-mixing plates are not middle electrodes to be suitable for the high current cut-off.

We claim:

1. A circuit interrupter which comprises:
a stationary casing;
a first contact formed in said stationary casing;
a second contact which is movably fitted to said stationary casing to be detachable to said first contact;
a cylinder-piston type negative pressure device comprising a suction chamber formed by a cylinder and a piston wherein said second contact is connected to said piston to form a negative pressure depending upon detaching operation of said first and second contact;
a gas storage chamber containing low pressure gas formed by said stationary casing and said first and second contacts in the closed state of said first and second contacts;
a suction guide formed by an opening formed in said second contact for connecting said storage chamber to said negative pressure device;
a discharge guide formed by the exterior of said second contact and by an interior wall of said stationary casing for closing and opening a path into and out of said storage chamber depending upon the detaching operation of said first and second contacts wherein said interior wall of said stationary casing which forms a portion of said discharge guide further comprises a tapered part distal to said gas storage chamber in order to form an enlarged portion of said discharge guide which portion of said discharge guide is larger than a portion of said discharge guide proximal to said gas storage chamber in order to provide for increased flow of gas out of said storage chamber when the distance between said first and second contacts reaches a predetermined value in the detaching operation.

2. The circuit interrupter according to claim 1, wherein said gas is $SF_6$ gas.

3. The circuit interrupter according to claim 1 wherein a space is remained in said suction chamber in the closing of said contacts.

4. The circuit interrupter according to claim 3 wherein the volume of said suction chamber in the closing step of said contacts is more than 5% of the maximum volume.

* * * * *

UNITED STATES PATENT AND TRADEMARK OFFICE

CERTIFICATE OF CORRECTION

PATENT NO. : 4,445,020

DATED : April 24, 1984

INVENTOR(S) : Yoshihiro Ueda et al

It is certified that error appears in the above-identified patent and that said Letters Patent is hereby corrected as shown below:

On the title page Inventors should read

--[75] Yoshihiro Ueda; Hiroyuki Sasao; Suenobu Hamano; Soichiro Okuda, all of Amagasaki, Japan --

Signed and Sealed this

*Twelfth* Day of *March 1985*

[SEAL]

*Attest:*

DONALD J. QUIGG

*Attesting Officer*

*Acting Commissioner of Patents and Trademarks*